US008314753B2

(12) United States Patent
Lee

(10) Patent No.: US 8,314,753 B2
(45) Date of Patent: Nov. 20, 2012

(54) PLASMA DISPLAY DEVICE

(75) Inventor: Joo-Yul Lee, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 464 days.

(21) Appl. No.: 12/621,440

(22) Filed: Nov. 18, 2009

(65) Prior Publication Data

US 2010/0141157 A1 Jun. 10, 2010

(30) Foreign Application Priority Data

Dec. 10, 2008 (KR) ..... 10-2008-0125379

(51) Int. Cl.
*G09G 3/10* (2006.01)

(52) U.S. Cl. ..... 345/42; 345/52; 345/62; 345/68; 345/208; 315/169.1; 315/169.3; 315/169.4

(58) Field of Classification Search ..... 345/41, 345/42, 52, 53, 55, 60, 62, 66–68, 100, 102, 345/204, 208, 211, 212; 315/169.1–169.4
See application file for complete search history.

(56) References Cited

U.S. PATENT DOCUMENTS 6,924,779 B2 * 8/2005 Lee et al. ..... 345/60
7,123,219 B2 * 10/2006 Lee ..... 345/76
7,307,601 B2 * 12/2007 Lee et al. ..... 345/60
2006/0061523 A1 * 3/2006 Kim et al. ..... 345/67
2007/0035480 A1 2/2007 Urushibata et al.
2009/0167740 A1 * 7/2009 Hashimoto et al. ..... 345/208

FOREIGN PATENT DOCUMENTS

JP 2007-047628 2/2007
JP 2007057737 A 3/2007
KR 10-0508956 B1 8/2005
KR 1020070048964 A 5/2007
KR 1020080044088 A 5/2008
KR 10-2008-0052880 6/2008

OTHER PUBLICATIONS

KIPO Office action dated Sep. 29, 2010, for Korean priority Patent application 10-2008-0125379, noting listed references in this IDS, as well as KR 10-2007-0048964, previously filed in an IDS dated Nov. 18, 2009.

* cited by examiner

*Primary Examiner* — Haiss Philogene
(74) *Attorney, Agent, or Firm* — Christie, Parker & Hale, LLP

(57) ABSTRACT

A plasma display device having a first diode with an anode coupled to an electrode. A first switch is coupled between a cathode of the first diode and a first voltage source that supplies a first voltage. A first inductor and a second switch are coupled in series between a power recovery capacitor and the cathode of the first diode, and a third switch is coupled between the anode of the first diode and a second voltage source that supplies a second voltage lower than the first voltage.

15 Claims, 12 Drawing Sheets

PLASMA DISPLAY DEVICE

CROSS-REFERENCE TO RELATED APPLICATION

This application claims priority to and the benefit of Korean Patent Application No. 10-2008-0125379 filed in the Korean Intellectual Property Office on Dec. 10, 2008, the entire content of which is incorporated herein by reference.

BACKGROUND OF THE INVENTION

1. Field of the Invention

The present invention relates to a plasma display device.

2. Description of the Related Art

A plasma display device includes a plasma display panel (PDP) for displaying text or images using plasma generated by gas discharge. It includes, depending on its size, more than several hundreds of thousands to millions of pixels arranged in a matrix pattern.

Generally, in a plasma display device, one frame is divided into respectively weighted subfields. During an address period of each subfield, an address pulse is applied to an address electrode of a discharge cell to be turned on (hereinafter referred to as "an on-cell") or a discharge cell to be turned off (hereinafter referred to as "an off-cell") while sequentially applying a scan voltage to a plurality of scan electrodes. In addition, a sustain discharge is performed on an on-cell by applying a sustain discharge pulse alternately having a high-level voltage and a low-level voltage to the plurality of scan electrodes during a sustain period.

In this case, the scan voltage is lower than the low-level voltage of the sustain discharge pulse so that a current path may be formed from the low-level voltage to the scan voltage through a body diode of a transistor that transmits the low-level voltage while a transistor that transmits the scan voltage is turned on. In order to prevent this current path, a path transistor is formed in the case that the low-level voltage is transmitted to the scan electrode.

However, the path transistor acts as a resistance component even when it is turned on so that waveforms applied to the scan electrode during the sustain period may be distorted. Further, the path transistor is realized as a large-capacitance switch for preventing excessive heat generation so that the production cost of the plasma display device increases.

SUMMARY OF THE INVENTION

Exemplary embodiments of the present invention provide a plasma display device for reducing distortion in waveforms applied to a scan electrode during a sustain period without increasing production cost.

A plasma display device according to an exemplary embodiment of the present invention includes an electrode, a first diode having an anode coupled to the electrode, a first switch coupled between a cathode of the first diode and a voltage source for supplying a first voltage, a power recovery capacitor, a first inductor and a second switch coupled in series between the power recovery capacitor and the cathode of the first diode, and a third switch coupled between the anode of the first diode and a second voltage source for supplying a second voltage that is lower than the first voltage.

A plasma display device according to an exemplary embodiment of the present invention includes a first electrode, a second electrode, a first diode having an anode coupled to the first electrode, a first switch coupled between a cathode of the first diode and a voltage source for supplying a first voltage, a first inductor and a second switch coupled in series between the cathode of the first diode and the second electrode, and a third switch coupled between the anode of the first diode and a second voltage source for supplying a second voltage that is lower than the first voltage.

DETAILED DESCRIPTION OF EXEMPLARY EMBODIMENTS

Figure 1:
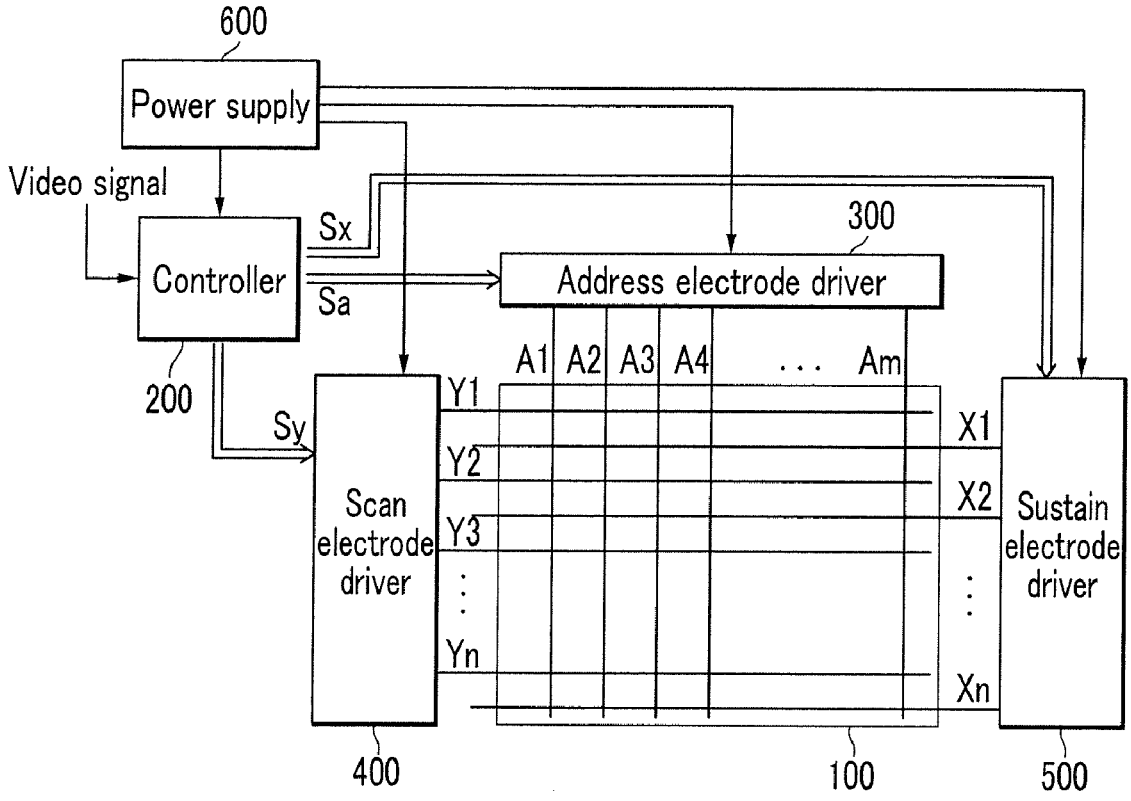
FIG. 1 is a schematic block diagram of a plasma display device according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "connected" to another element, the element may be "directly connected" to the other element or "electrically connected" to the other element through a third element unless explicitly described to the contrary.

A wall charge will be described as being "formed" or "accumulated" on the electrodes, although the wall charges do not actually touch the electrodes. Further, a wall voltage refers to a potential difference formed on the wall of the discharge cell by the wall charge.

When it is described in the specification that a voltage is maintained, it should not be understood to strictly imply that the voltage is maintained exactly at a predetermined voltage. To the contrary, even if a voltage difference between two points varies, the voltage difference is expressed to be maintained at a predetermined voltage in the case that the variance is within a range allowed in design constraints or in the case that the variance is caused due to a parasitic component that is usually disregarded by a person of ordinary skill in the art. Furthermore, a threshold voltage of semiconductor devices, such as transistors and diodes, is very much lower than a discharge voltage. It is therefore considered that the threshold voltage is effectively 0V, and the threshold voltage is approximated.

Hereinafter, a plasma display device according to an exemplary embodiment of the present invention will be described in further detail with reference to the drawings.

FIG. 1 is a schematic block diagram of a plasma display device according to an exemplary embodiment.

Referring to FIG. 1, the plasma display device includes a plasma display panel (PDP) 100, a controller 200, an address electrode driver 300, a scan electrode driver 400, a sustain electrode driver 500, and a power supply unit 600.

The PDP 100 includes a plurality of address electrodes A1 to Am extending in a column direction, and a plurality of sustain electrodes X1 to Xn and a plurality of scan electrodes Y1 to Yn extending in a row direction. Each of the sustain electrodes X1 to Xn is formed in correspondence to a respective one of the scan electrodes Y1 to Yn, and the ends of the sustain electrodes X1 to Xn may be commonly connected to each other. In addition, the PDP 100 is formed of a substrate on which the sustain electrodes X1 to Xn and the scan electrodes Y1 to Yn are arranged and a substrate on which the address electrodes A1 to Am are arranged. The two substrates are placed facing each other with a discharge space therebetween so that the scan electrodes Y1 to Yn and the sustain electrodes X1 to Xn perpendicularly cross the address electrodes A1 to Am. In this case, discharge cells are defined in discharge spaces at crossings of the address electrodes A1 to Am, the sustain electrodes X1 to Xn, and the scan electrodes Y1 to Yn. The above described structure is an exemplary structure of the PDP 100, and panels of other structures can be applied to the present invention.

The controller 200 receives external video signals and outputs an address electrode driving control signal Sa, a sustain electrode driving control signal Sx, and a scan electrode driving control signal Sy. In addition, the controller 200 divides one frame into a plurality of subfields and drives the subfields, and each subfield includes a reset period, an address period, and a sustain period with respect to time.

The address electrode driver 300 receives the address electrode control signal Sa from the controller 200, and applies display data signals for selecting the discharge cells to the address electrodes A1 to Am.

The scan electrode driver 400 receives the scan electrode driving control signal Sy from the controller 200 and applies a driving voltage to the scan electrodes Y1 to Yn.

The sustain electrode driver 500 receives the sustain electrode driving control signal Sx from the controller 200 and applies a driving voltage to the sustain electrodes X1 to Xn.

The power supply 600 supplies voltages required for driving the plasma display device to the controller 200 and the drivers 300, 400, and 500.

Hereinafter, driving waveforms of the plasma display device according to an exemplary embodiment of the present invention will be described with reference to FIG. 2.

Figure 2:
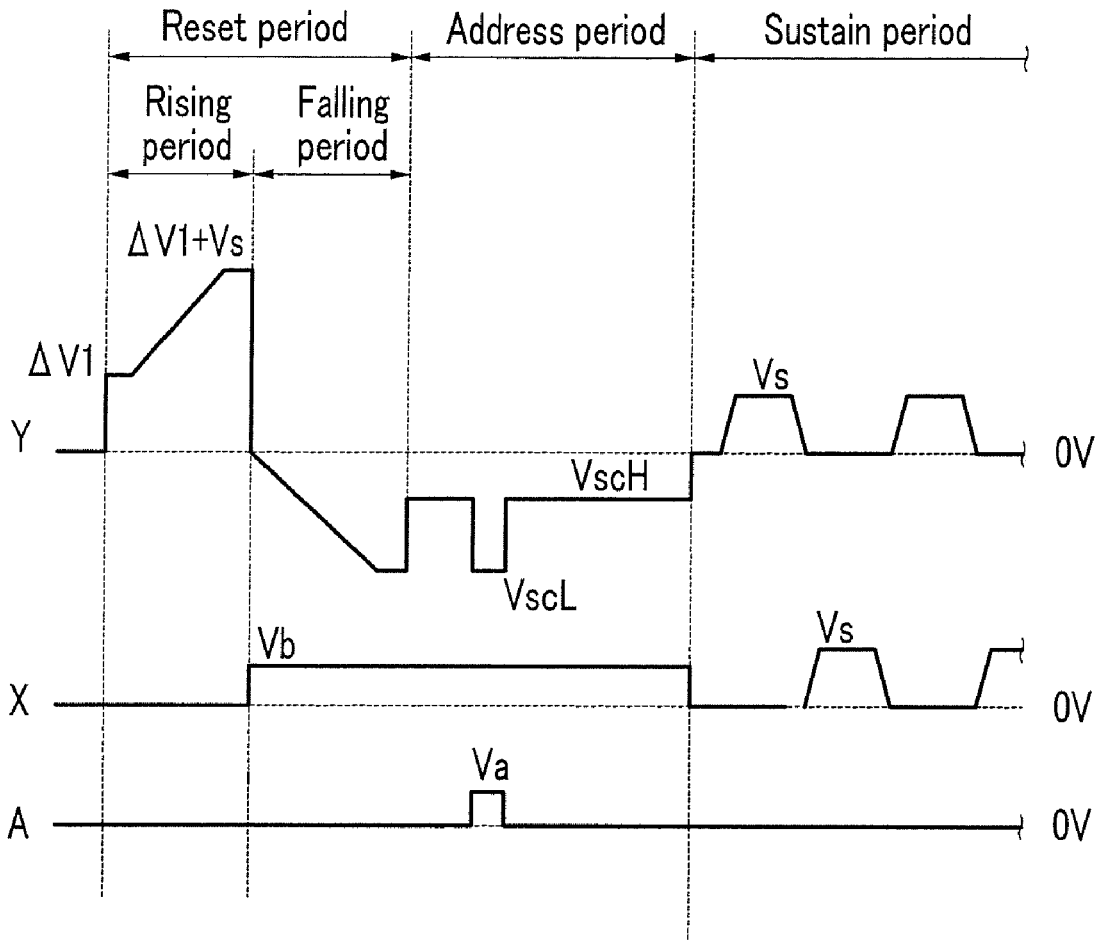
FIG. 2 is a schematic view of a driving waveform of the plasma display device according to an exemplary embodiment of the present invention.

FIG. 2 schematically shows driving waveforms of the plasma display device according to the exemplary embodiment of the present invention.

In FIG. 2, only one subfield among a plurality of subfields are shown for convenience, and driving waveforms applied to a scan electrode Y, a sustain electrode X, and an address electrode A of one cell will be described.

First, a reset period will be described. The reset period includes a rising period and a falling period. During the rising period, in a state where the address electrode A and the sustain electrode X are maintained at a reference voltage (e.g., 0V in FIG. 2), a voltage of the scan electrode Y is gradually increased from a voltage ΔV1 to a voltage (ΔV1+Vs). In this case, a weak discharge is generated between the scan electrode Y and the sustain electrode X and between the scan electrode Y and the address electrode A. Accordingly, negative wall charges are formed on the scan electrode Y, and positive wall charges are formed on the sustain electrode X and the address electrode A. In order to reset all discharge cells during the reset period, the voltage (ΔV1+Vs) is set to a suitable voltage that is high enough to cause a discharge in all the discharge cells under any practical operating condition.

During the falling period, the voltage of the scan voltage Y is gradually decreased from a reference voltage to a voltage VscL while the voltage of the address electrode A and the voltage of the sustain electrode X are maintained at the reference voltage and a voltage Vb, respectively. In the falling period, a weak discharge is generated between the scan electrode Y and the sustain electrode X and between the scan electrode Y and the address electrode A so that negative wall charges formed on the scan electrode Y and positive wall charges formed on the sustain electrode X and the address electrode A during the rising period are erased. A voltage (VscL−Vb) may be set to a suitable discharge firing voltage Vf between the scan electrode Y and the sustain electrode X, and accordingly, a wall voltage difference between the scan electrode Y and the sustain electrode X may become close to 0V so that a discharge cell that has not experienced an address discharge during the address period can be prevented from experiencing a misfire.

During the address period, a scan pulse having the voltage VscL (i.e., the scan voltage) is sequentially applied to the plurality of scan electrodes Y1 to Yn while the sustain electrode X is applied with the voltage Vb so as to select on-cells. Concurrently, an address voltage is applied to an address electrode A that crosses an on-cell among a plurality of discharge cells defined by the scan electrode Y to which the voltage VscL is applied. Then, an address discharge is generated between the address electrode A to which the address voltage Va is applied and the scan electrode Y to which the voltage VscL is applied and between the scan electrode Y to which the voltage VscL is applied and a corresponding sustain electrode X. Accordingly, positive wall charges are formed on the scan electrode Y, and negative wall charges are formed on the address electrode A and the sustain electrode X, respectively. In addition, a scan electrode Y to which the voltage VscL is not applied is applied with a voltage VscH (i.e., a non-scan voltage) that is higher than the voltage VscL, and an address electrode A of an unselected discharge cell is applied with the reference voltage.

During the sustain period, a sustain pulse having a high level voltage (e.g., Vs in FIG. 2) and a low level voltage (e.g., 0V in FIG. 2) is alternately applied to the scan electrode Y and the sustain electrode X. That is, the 0V voltage is applied to the sustain electrode X when the voltage Vs is applied to the scan electrode, and the 0V voltage is applied to the scan electrode Y when the voltage Vs is applied to the sustain electrode X. A sustain discharge is generated between the scan electrode Y and the sustain electrode X by a wall voltage formed between the scan electrode Y and the sustain electrode X due to the address discharge and the applied voltage Vs. The sustain pulse is alternately applied to the scan electrode Y and the sustain electrode X for a number of times corresponding to a weight of the corresponding subfield.

The scan electrode driver 400 according to the exemplary embodiment of the present invention will be described with reference to FIG. 3 to FIG. 10.

Hereinafter, although a switch is illustrated as an N-channel field effect transistor (FET) having a body diode, other switch that performs a same or similar function can be used to replace the transistor. Further, a capacitive component formed by the sustain electrode X and the scan electrode Y is illustrated as a panel capacitor Cp.

Figure 3:
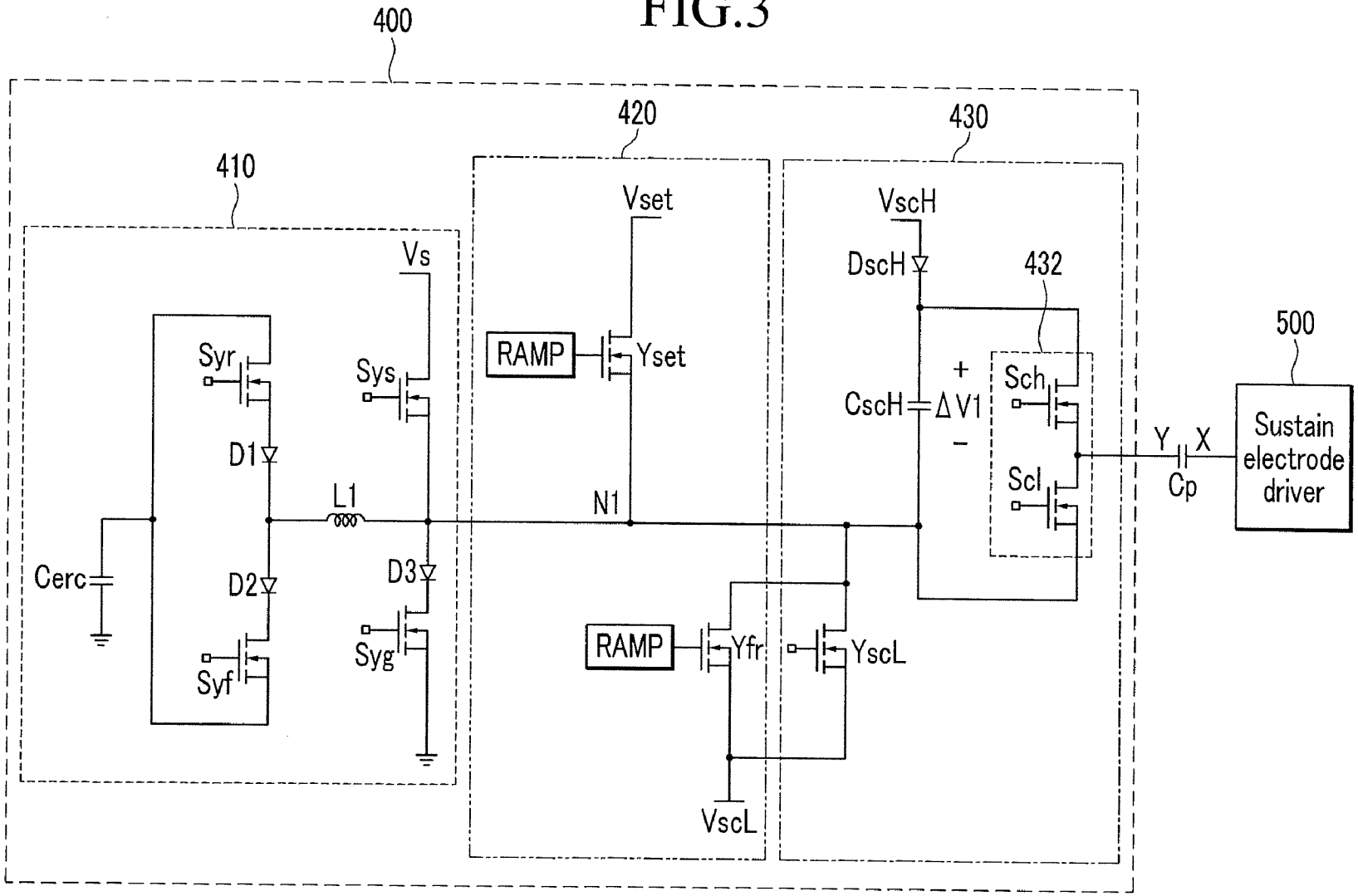
FIGS. 3, 4, 5, 6, 7, 10, 11 and 12 are schematic circuit diagrams of a driving circuit of the plasma display device according to the exemplary embodiment of the present invention.

FIG. 3 is a schematic circuit diagram of a plasma display device according to an exemplary embodiment of the present invention.

Referring to FIG. 3, the scan electrode driver 400 includes a sustain driver 410, a reset driver 420, and a scan driver 430.

The scan driver 430 includes a switch YscL, a capacitor CscH, a diode DscH, and a scan circuit 432.

An anode of the diode DscH is connected to a voltage source VscH supplying a voltage VscH, and a cathode thereof is connected to one terminal of the capacitor CscH. A drain of the switch YscL is connected with the other terminal of the capacitor CscH, and a source thereof is connected to a voltage source VscL that supplies a voltage VscL.

The capacitor CscH is charged to a voltage ΔV1 as shown in FIG. 3 (i.e., a voltage difference between VscH and VscL). When the switch YscL is turned on, the capacitor CscH is charged to a voltage of (VscH−VscL), i.e., the voltage ΔV1.

The scan circuit 432 includes a switch Sch and a switch Scl.

A drain of the switch Sch is connected to a node between the diode DscH and the capacitor CscH, and a source thereof is connected to the scan electrode Y. A drain of the transistor Scl is connected to the scan electrode Y, and a source thereof is connected to a node between the capacitor CscH and the switch YscL.

In the address period, the scan circuit 432 applies the voltage VscL to the scan electrode Y that is selected, and applies the voltage VscH to the scan electrode Y that is not selected.

A plurality of scan circuit 432 may be respectively connected to the plurality of scan electrodes Y1-Yn so as to sequentially select the plurality of scan electrodes Y1-Yn in the address period. The plurality of scan circuit 432 may be formed as an integrated circuit (IC). Other driving circuits of the scan electrode driver 400 may be commonly connected to the plurality of scan electrodes Y1-Yn through the plurality of scan circuits 432. In FIG. 3, one scan circuit 432 corresponding to one scan electrode Y is illustrated.

The sustain driver 410 includes a power recovery capacitor Cerc, switches Syr, Syf, Syg, and Sys, diodes D1, D2, and D3, and an inductor L1.

One terminal of the capacitor Cerc is connected to a voltage terminal, for example, a ground terminal, and a drain of the switch Syr is connected to the other terminal of the capacitor Cerc. In addition, a source of the switch Syf is connected to a node between the capacitor Cerc and the switch Syr. An anode of the diode D1 is connected to the source of the switch Syr. A cathode of the diode D2 is connected to a drain of the switch Syf, and an anode thereof is connected to a cathode of the diode D1. One terminal of the inductor L1 is connected to a node between the diode D1 and the diode D2, and the other terminal thereof is connected to the other terminal of the capacitor CscH. A drain of the switch Sys is connected to a voltage source Vs that supplies a voltage Vs, and a source thereof is connected to the other terminal of the inductor L1. An anode of the diode D3 is connected to a node N1 between the inductor L1 and the switch Sys. A drain of the switch Syg is connected to a cathode of the diode D3, and a source thereof is connected to a voltage source for supplying the low level voltage of the sustain pulse, e.g., the ground terminal.

Here, the diode D3 prevents a current path from the ground terminal through the body diode of the switch Syg to the node N1 from being generated. That is, the diode D3 may operate as a path switch of a typical plasma display device. However, unlike the path switch, the diode D3 reduces the distortion of waveforms applied to the scan electrode Y during the sustain period and reduces production cost.

The reset driver 420 includes switches Yset and Yfr.

A drain of the switch Yset is connected to a voltage source that supplies a voltage Vset, and a source thereof is connected to the node N1. In addition, a drain of the switch Yfr is connected to the node N1, and a source thereof is connected to a voltage source that supplies the voltage VscL.

Figure 4:
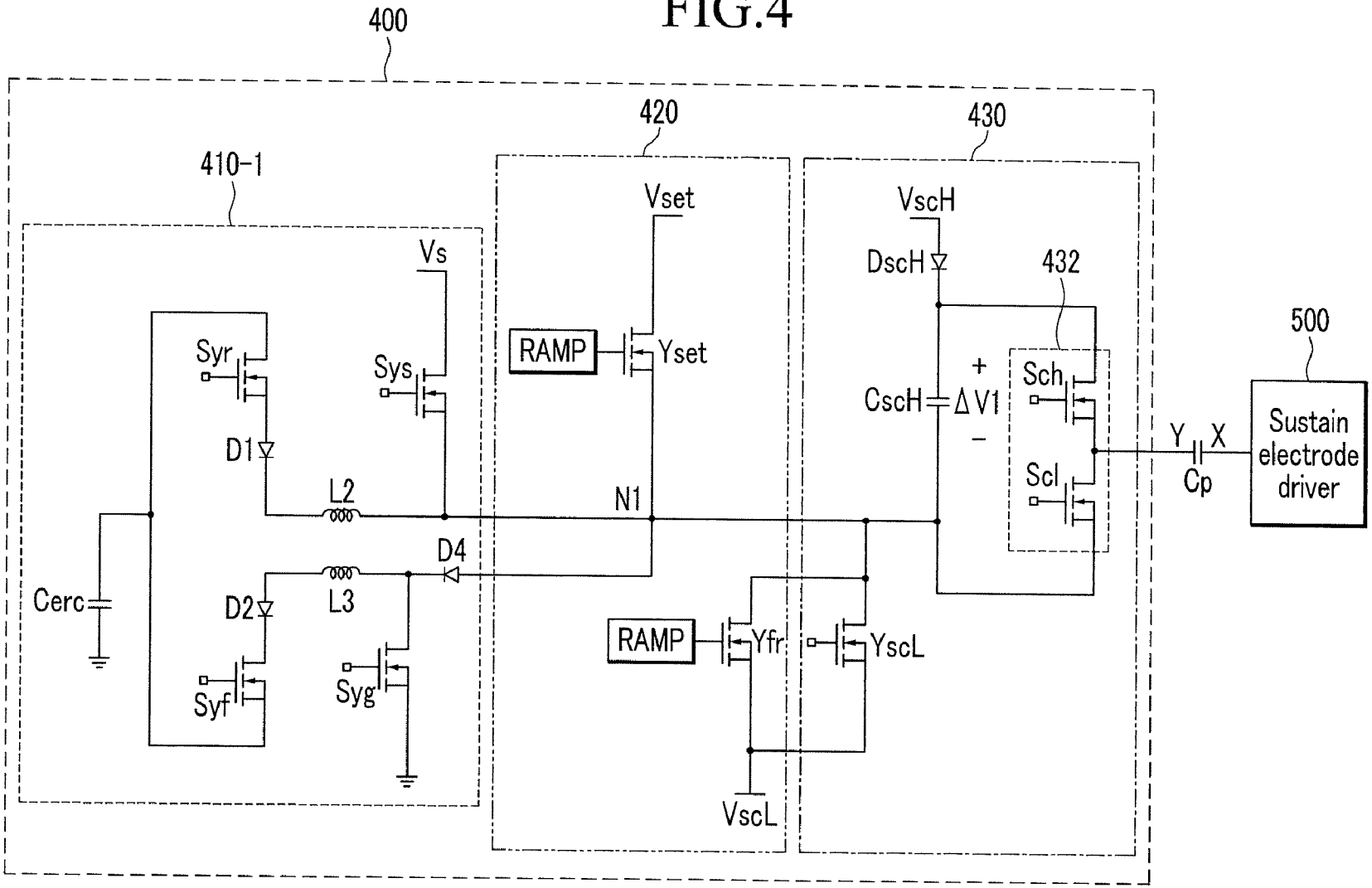

FIG. 4 is a schematic circuit diagram of a driving circuit of a plasma display device according to an exemplary embodiment of the present invention.

Referring to FIG. 4, a sustain driver 410-1 of a scan electrode driver may include a diode D4 of which an anode is connected to a node N1, and a cathode thereof is connected to a drain of a switch Syg, and an inductor L3 of which one terminal is connected to a node between the switch Syg and the diode D4, and the other terminal is connected to an anode of the diode D2. During a sustain period, the sustain driver 410-1 allows a current to flow through an inductor L2 when increasing a voltage of a scan electrode Y, and allows the current to flow through the inductor L3 when decreasing the voltage of the scan electrode Y.

Figure 5:
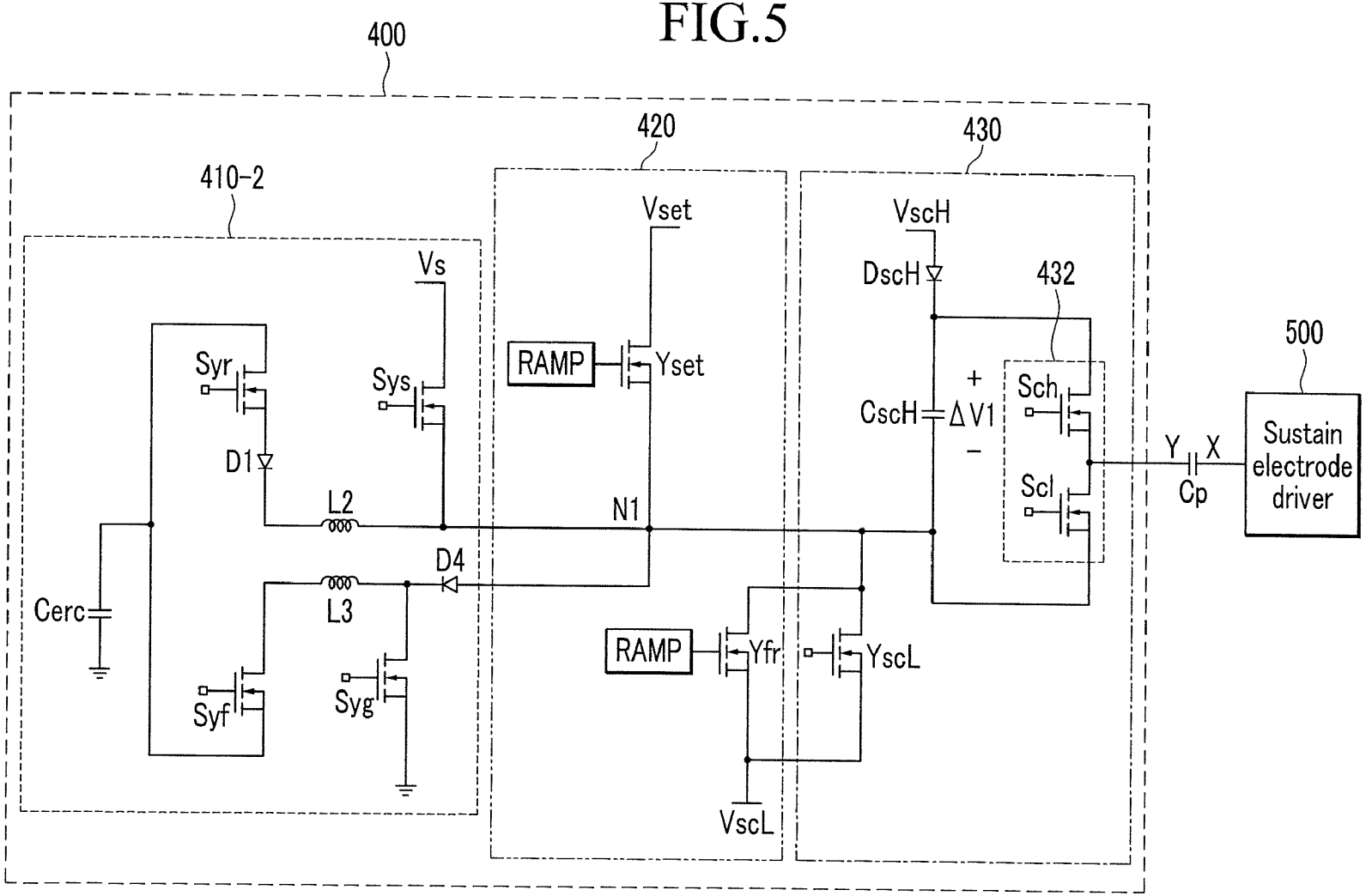

FIG. 5 is a schematic circuit diagram of a driving circuit of a plasma display device according an exemplary embodiment of the present invention.

Referring to FIG. 5, unlike as shown in FIG. 4, in a sustain driver 410-2 of a scan electrode driver, the other terminal of an inductor L3 is directly connected to a drain of a switch Syf. That is, the diode D2 in the driving circuit of FIG. 4 is eliminated, thereby reducing production cost.

Figure 6:
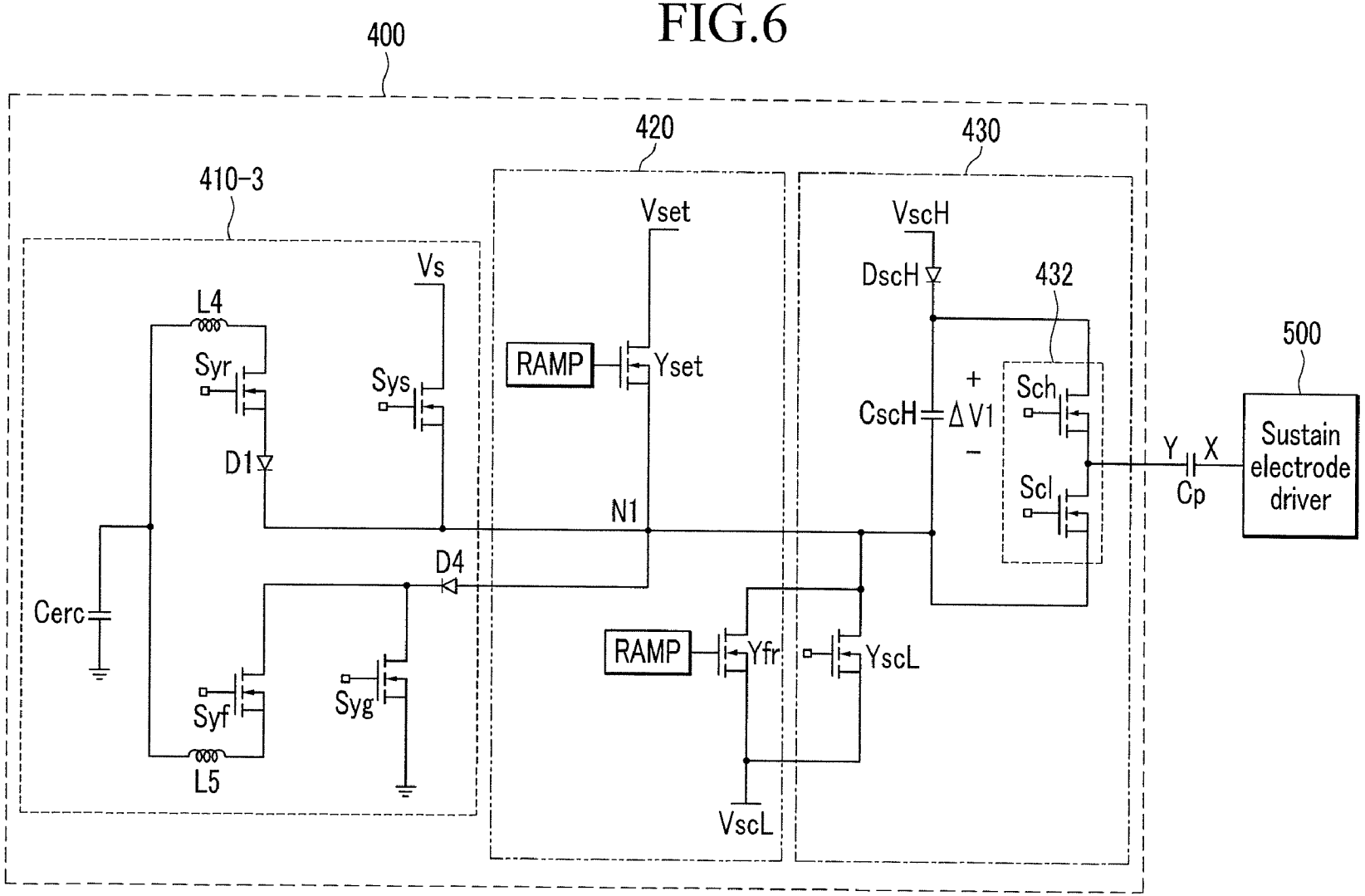

In addition, as shown in FIG. 6, locations of the inductors L2 and L3 in the driving circuit of FIG. 5 may be changed.

FIG. 6 is a schematic circuit diagram of a driving circuit of a plasma display device according to an exemplary embodiment of the present invention.

Referring to FIG. 6, unlike as shown in FIG. 5, in a sustain driver 410-3 of a scan electrode driver, a cathode of a diode D1 is directly connected to a node N1, and a cathode of a diode D4 is directly connected to a drain of a switch Syf. Further, an inductor L4 is connected between a switch Syr and a capacitor Cerc, and an inductor L5 is connected between the switch Syf and the capacitor Cerc.

Figure 7:
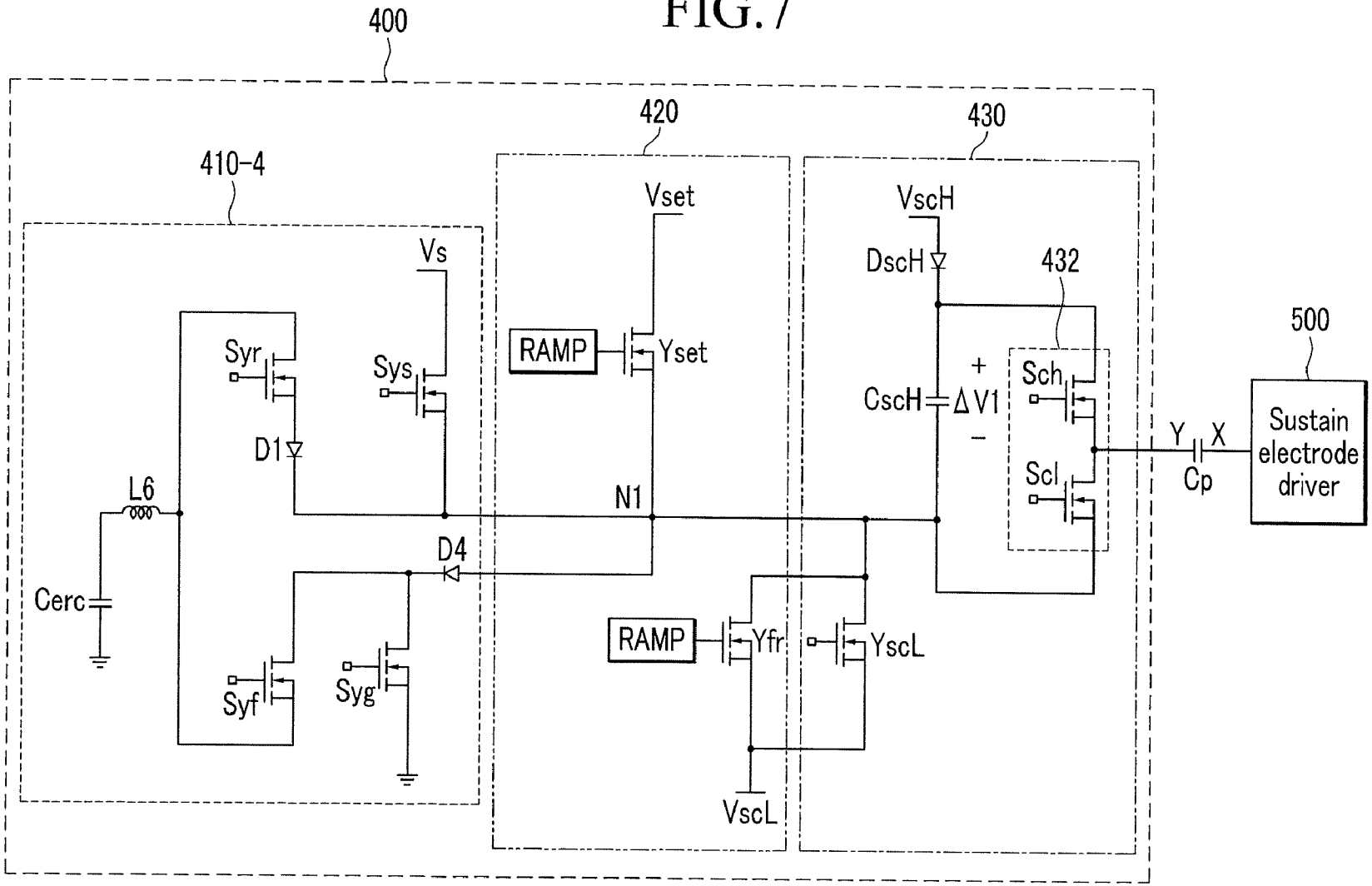

FIG. 7 is a schematic circuit diagram of a driving circuit of a plasma display device according to an exemplary embodiment of the present invention.

As shown in FIG. 7, the two inductors L4 and L5 of the sustain driver 410-3 of FIG. 6 may be replaced with a single inductor L6.

Referring to FIG. 7, unlike as shown in FIG. 6, in a sustain driver 410-4 of a scan electrode driver, one inductor L6 is connected between a capacitor Cerc and two switches Syr and Syf.

Next, a method of generating the waveforms shown in FIG. 2 during a sustain period will be described with reference to FIG. 8 and FIG. 9. Here, the driving circuit shown in FIG. 5 will be exemplarily described to illustrate the method.

Figure 8:
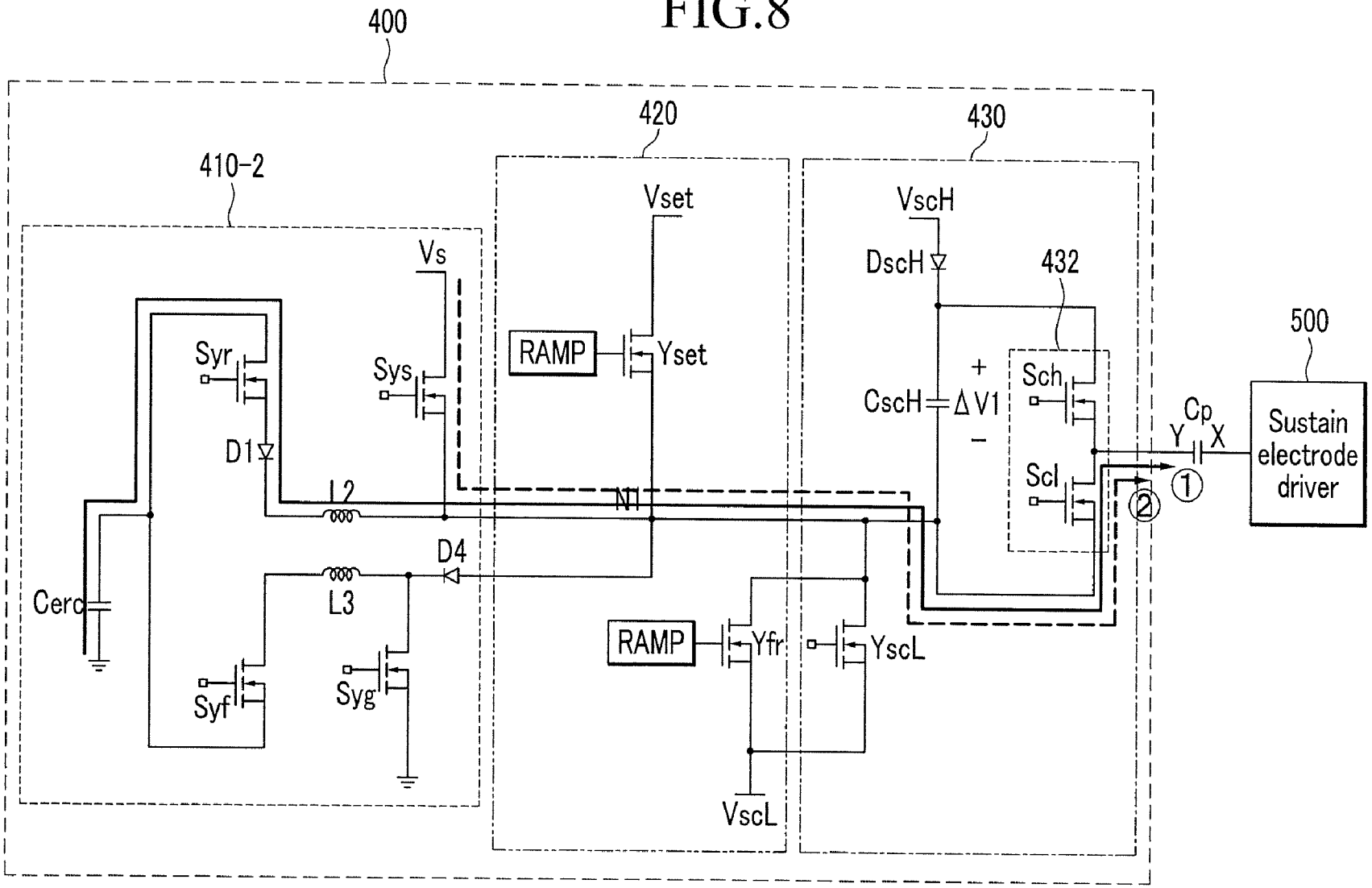
FIGS. 8 and FIG. 9 are schematic circuit diagrams showing operation of the driving circuit of FIG. 5 during a sustain period.
Figure 9:
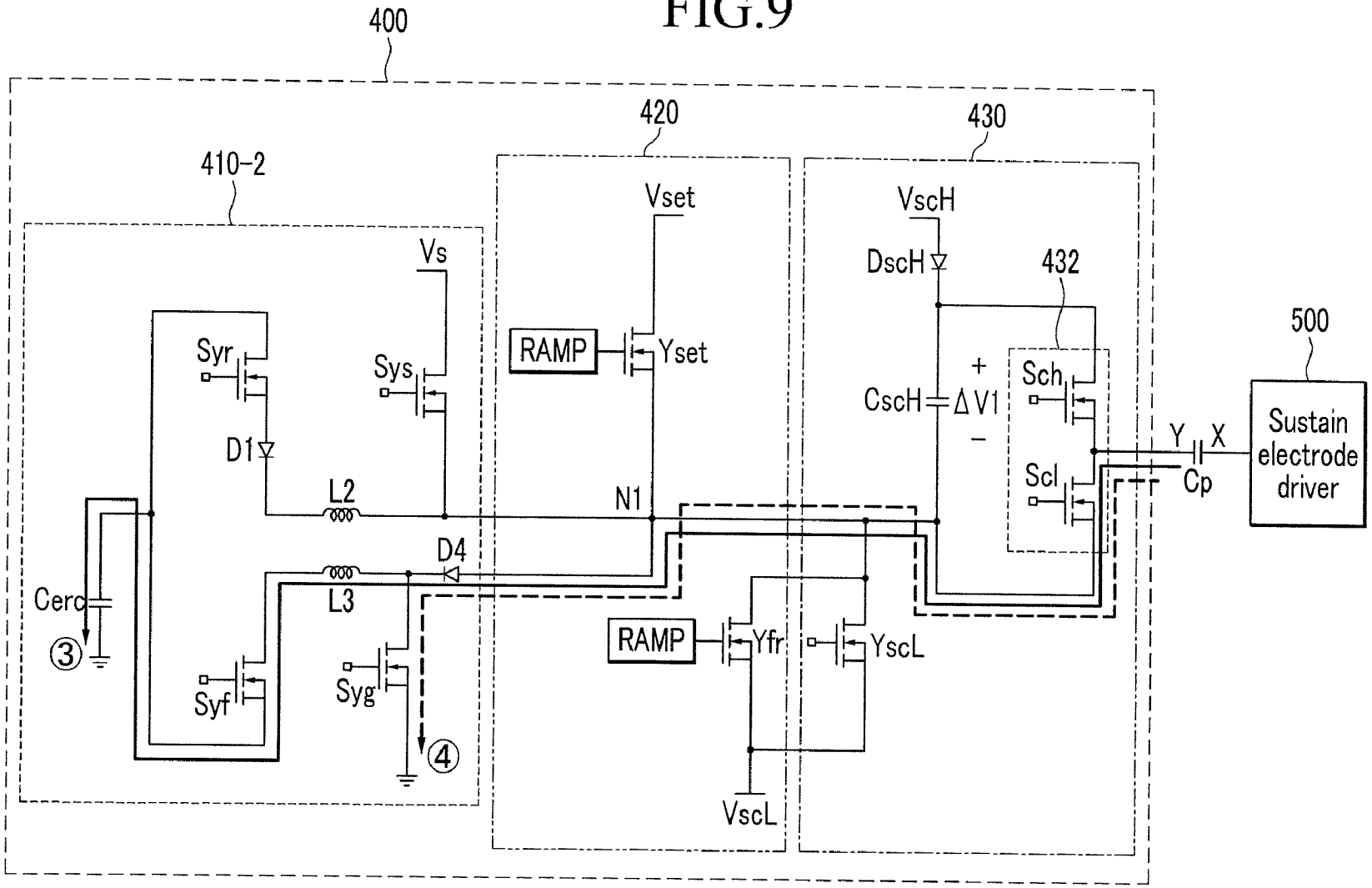

FIG. 8 and FIG. 9 show the operation of the driving circuit shown in FIG. 5 during the sustain period.

First, referring to FIG. 8, as the switches Scl and Syr are turned on, a current path ① is formed from the ground terminal to the scan electrode Y passing through the capacitor Cerc, the switch Syr, the diode D1, the inductor L2, and a body diode of the switch Scl. As a current flows through the current path ①, a resonance occurs between the inductor L2 and the panel capacitor Cp, and thereby the voltage of the scan electrode Y is increased from 0V.

When the voltage of the scan electrode Y is increased close to the voltage Vs, the switch Sys is turned on. Accordingly, the voltage Vs is applied to the scan electrode Y through a current path ② formed from the voltage source Vs to the scan electrode Y passing through the switch Sys and the body diode of the switch Scl. In this case, the switch Syr is turned off.

Next, referring to FIG. 9, as the switch Sys is turned off and the switch Syf is turned on, a current path ③ is formed from the scan electrode Y to the ground terminal passing through the switch Scl, the diode D4, the inductor L3, the switch Syf, and the capacitor Cerc. As a current flows through the current path ③, a resonance occurs between the panel capacitor Cp and the inductor L3, and thereby the voltage of the scan electrode is decreased from the voltage Vs.

When the voltage of the scan electrode Y is decreased close to the 0V voltage, the switch Syg is turned on. Accordingly, the 0V voltage is applied to the scan electrode Y through a current path ④ formed from the scan electrode Y to the ground terminal passing through the switch Scl, the diode D4, and the switch Syg. In this case, the switch Syf is turned off.

By repeating the above described operation, the voltage Vs and the 0V voltage can be alternately applied to the scan electrode Y.

Instead of utilizing the capacitor Cerc in the driving circuits of FIG. 5 to FIG. 7, a parallel energy recovery circuit may be formed by connecting one terminal of each of the sustain drivers 410-2 to 410-4 to the sustain electrode X, and such a driving circuit will now be described with reference to FIG. 10 to FIG. 12.

Figure 10:
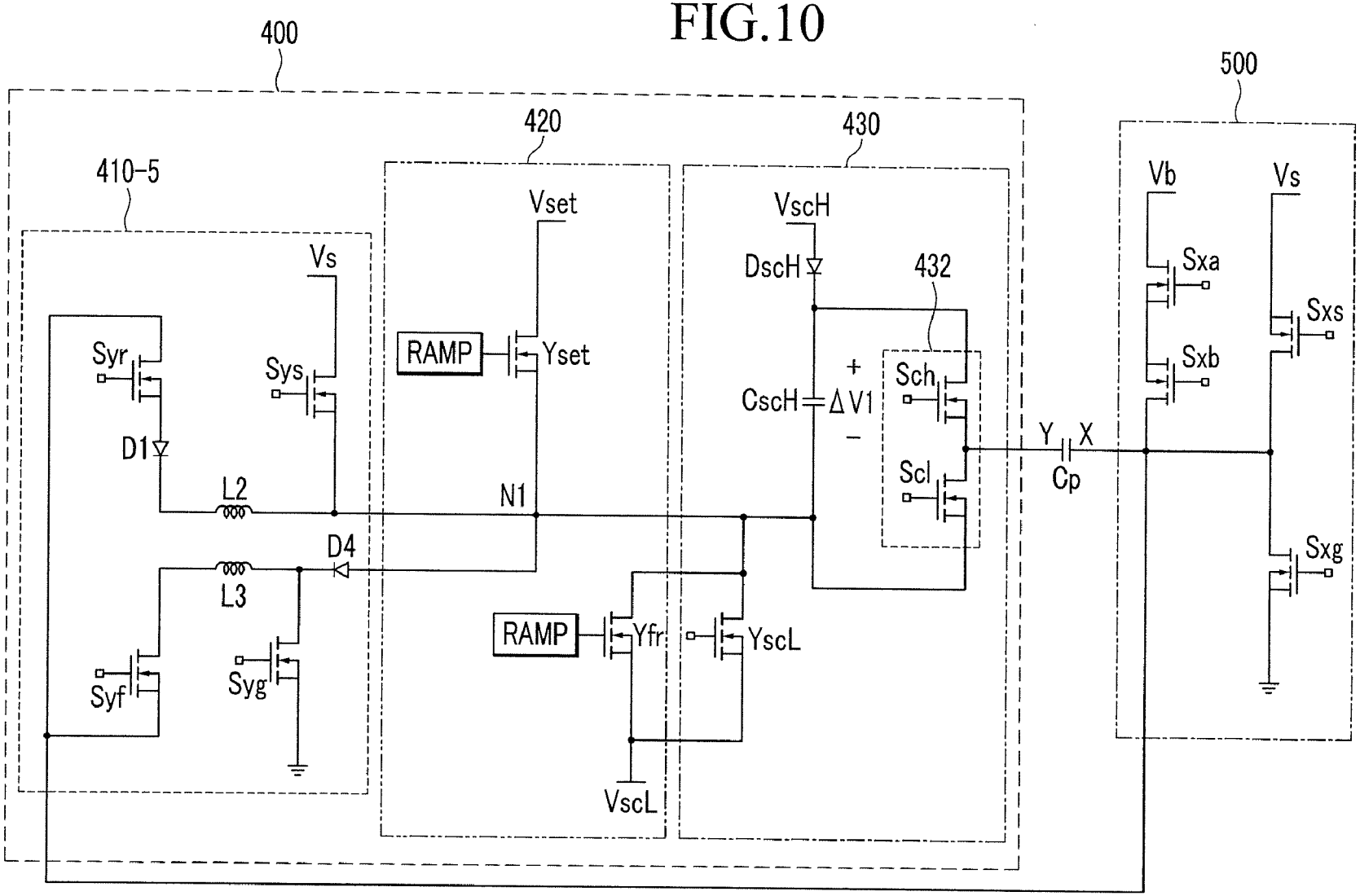
Figure 11:
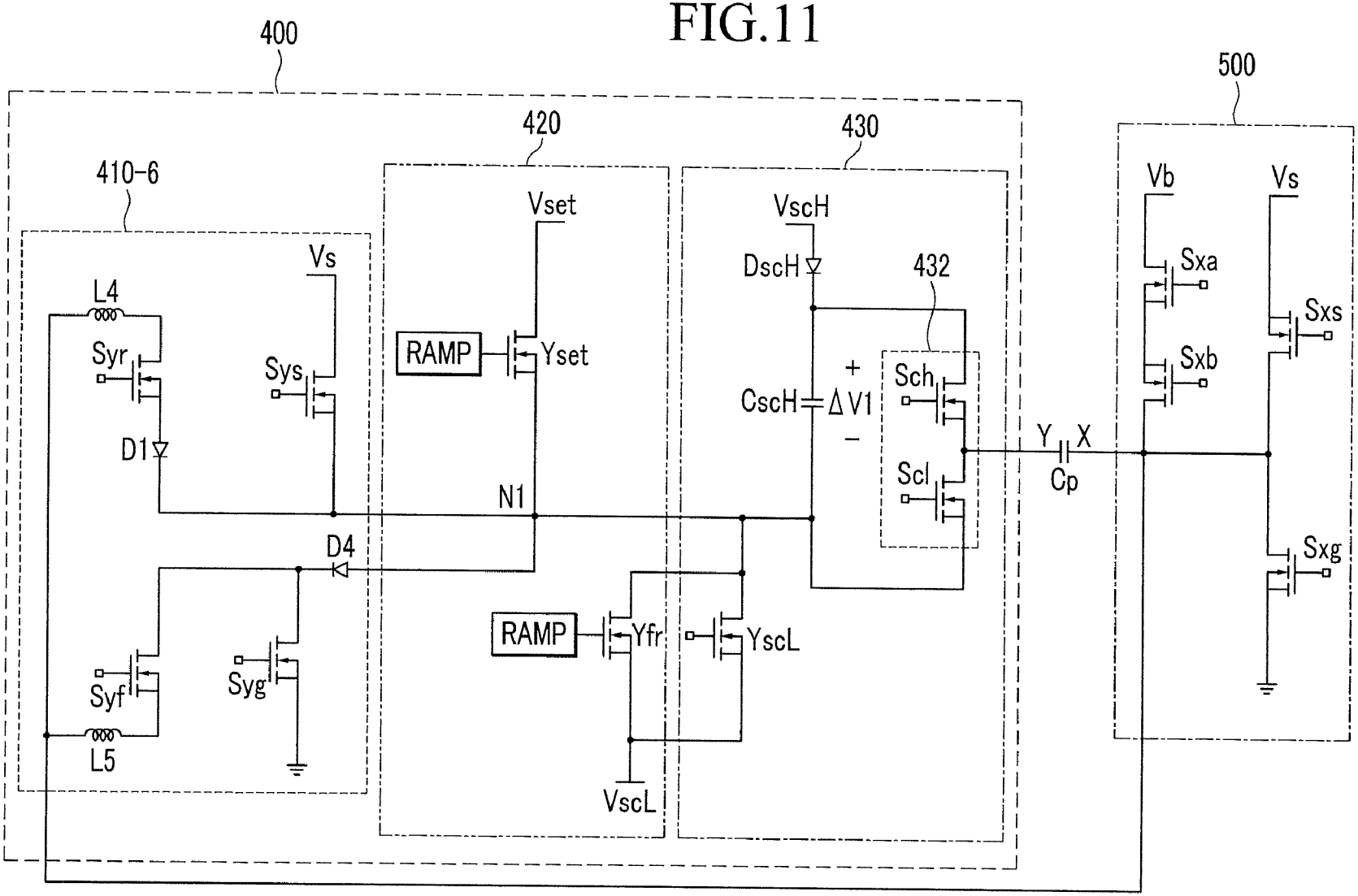
Figure 12:
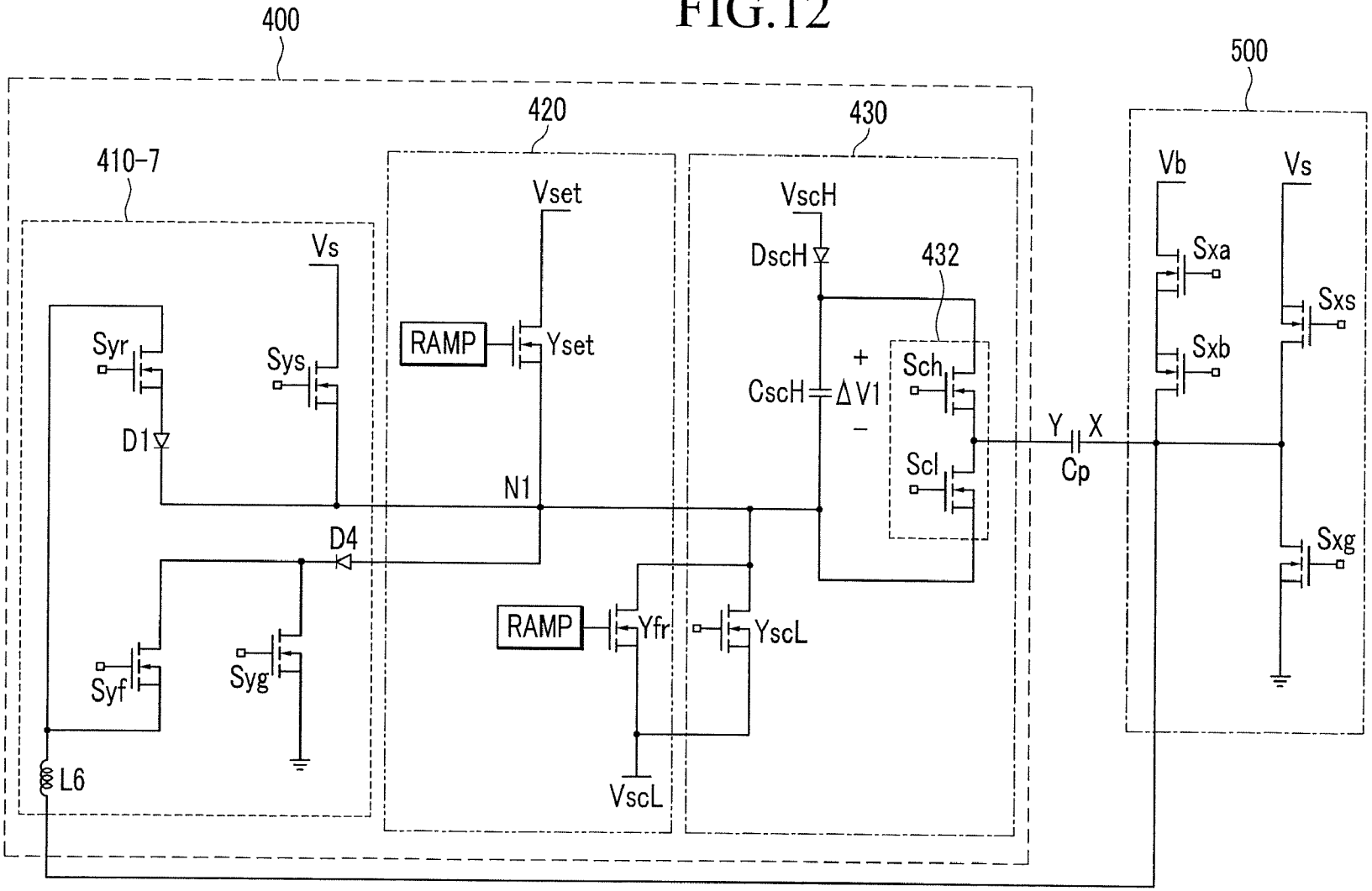

FIG. 10 to FIG. 12 respectively show a schematic circuit diagram of a driving circuit of a plasma display device according to exemplary embodiments of the present invention.

Referring to FIG. 10, unlike as shown in FIG. 5, in a sustain driver 410-5 of a scan electrode driver, a drain of a switch Syr and a source of a switch Syf are connected to a sustain electrode X.

Referring to FIG. 11, unlike as shown in FIG. 6, in a sustain driver 410-6 of a scan electrode driver, inductors L4 and L5 are connected to a sustain electrode X.

Referring to FIG. 12, unlike as shown in FIG. 7, in a sustain driver 410-7 of a scan electrode driver, an inductor L6 is connected to a sustain electrode X.

Referring back to FIG. 10 to FIG. 12, a sustain electrode driver 500 includes switches Sxs, Sxg, Sxa, and Sxb.

A drain of the switch Sxs is connected to a voltage source Vs that supplies a voltage Vs, and a source thereof is connected to a sustain electrode X. A drain of the switch Sxg is connected to the sustain electrode X, and a source thereof is connected to a voltage source supplying the low level voltage of the sustain pulse, i.e., the ground terminal.

The switches Sxa and Sxb are back-to-back connected between a voltage source that supplies a voltage Vb and the sustain electrode X, and is turned on while a scan pulse is applied to a scan electrode Y during an address period so that it can bias the sustain electrode X with the voltage Vb.

In the above described structure, a resonance occurs between an inductor and a panel capacitor by using a voltage difference between the scan electrode Y and the sustain electrode X, and accordingly, a voltage of the scan electrode Y and a voltage of the sustain electrode X are changed. In further detail, when 0V voltage is applied to the scan electrode Y and the voltage Vs is applied to the sustain electrode X, the switch Syr is turned on to increase the voltage of the scan electrode Y and decrease the voltage of the sustain electrode X, and then the switches Sys and Sxg are turned on to apply the voltage Vs to the scan electrode Y and 0V voltage to the sustain electrode X, respectively. In addition, after the voltage Vs is applied to the scan electrode Y and the 0V voltage is applied to the sustain electrode X, the switch Syf is turned on to decrease the voltage of the scan electrode Y and increase the voltage of the sustain electrode X, and then the switches Syg and Sxs are turned on to apply the 0V voltage to the scan electrode Y and the voltage Vs to the sustain electrode X.

As described above, the plasma display devices according to the exemplary embodiments of the present invention use a diode instead of a switch so that production cost can be reduced and distortion of waveforms applied to a scan electrode Y during a sustain period can be reduced or prevented. Furthermore, the plasma display devices according to the exemplary embodiments of the present invention described in FIG. 5 through FIG. 12 can reduce production cost by eliminating the diode D2

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims and their equivalents.

What is claimed is:

1. A plasma display device comprising:

an electrode;

a first diode having an anode coupled to the electrode;

a first switch coupled between a cathode of the first diode and a first voltage source for supplying a first voltage;

a power recovery capacitor;

a first inductor and a second switch coupled in series between the power recovery capacitor and the cathode of the first diode; and a third switch coupled between the anode of the first diode and a second voltage source for supplying a second voltage that is lower than the first voltage, wherein, during a sustain period, a voltage of the electrode is decreased by turning on the second switch, and then the first switch is turned on to apply the first voltage to the electrode.

2. The plasma display device of claim 1, wherein the first diode substantially blocks a current path from the first voltage source to the second voltage source when the third switch is turned on.

3. The plasma display device of claim 1, wherein a first terminal of the first inductor is coupled to the cathode of the first diode, and the second switch is coupled between a second terminal of the first inductor and the power recovery capacitor.

4. The plasma display device of claim 1, wherein a first terminal of the first inductor is coupled to the power recovery capacitor, and the second switch is coupled between a second terminal of the first inductor and the cathode of the first diode.

5. A plasma display device comprising:

an electrode;

a first diode having an anode coupled to the electrode;

a first switch coupled between a cathode of the first diode and a first voltage source for supplying a first voltage;

a power recovery capacitor;

a first inductor and a second switch coupled in series between the power recovery capacitor and the cathode of the first diode;

a third switch coupled between the anode of the first diode and a second voltage source for supplying a second voltage that is lower than the first voltage, a fourth switch coupled between a third voltage source and the electrode, the third voltage source for supplying a third voltage higher than the first voltage; and a fifth switch, a second diode, and a second inductor coupled in series between the power recovery capacitor and the anode of the first diode.

6. The plasma display device of claim 5, wherein an inductance of the first inductor is substantially the same as the second inductor.

7. The plasma display device of claim 5, wherein, during a sustain period, the voltage of the electrode is increased by turning on the fifth switch, and then the third voltage is applied to the electrode by turning on the fourth switch.

8. The plasma display device of claim 7, wherein the first diode substantially blocks a current path through the second switch while the voltage of the electrode is increased by turning on the fifth switch.

9. A plasma display device comprising:

a first electrode;

a second electrode;

a first diode having an anode coupled to the first electrode;

a first switch coupled between a cathode of the first diode and a first voltage source for supplying a first voltage;

a first inductor and a second switch coupled in series between the cathode of the first diode and the second electrode; and a third switch coupled between the anode of the first diode and a second voltage source for supplying a second voltage that is lower than the first voltage.

10. The plasma display device of claim 9, further comprising:

a fourth switch coupled between a third voltage source and the first electrode, the third voltage source for supplying a third voltage that is higher than the first voltage; and a fifth switch, a second diode, and a second inductor coupled in series between the second electrode and the anode of the first diode.

11. The plasma display device of claim 9, wherein the first diode substantially blocks a current path from the first voltage source to the second voltage source when the third switch is turned on.

12. The plasma display device of claim 9, wherein, during a sustain period, a voltage of the first electrode is decreased by turning on the second switch, and then the first switch is turned on to apply the first voltage to the first electrode.

13. The plasma display device of claim 10, wherein an inductance of the first inductor is substantially the same as the second inductor.

14. The plasma display device of claim 10, wherein, during a sustain period, a voltage of the first electrode is increased by turning on the fifth switch, and then the fourth switch is turned on to apply the third voltage to the first electrode.

15. The plasma display device of claim 14, wherein the first diode substantially blocks a current path through the second switch while the voltage of the first electrode is increased by turning on the fifth switch.

* * * * *